US006810868B2

(12) United States Patent
Tsunenaga et al.

(10) Patent No.: US 6,810,868 B2
(45) Date of Patent: Nov. 2, 2004

(54) IGNITION COIL FOR INTERNAL COMBUSTION ENGINE

(75) Inventors: Koji Tsunenaga, Chiryu (JP); Kazutoyo Osuka, Gamagori (JP); Jyunichi Wada, Chita-gun (JP)

(73) Assignee: Denso Corporation, Kariya (JP)

( * ) Notice: Subject to any disclaimer, the term of this patent is extended or adjusted under 35 U.S.C. 154(b) by 3 days.

(21) Appl. No.: 10/356,544

(22) Filed: Feb. 3, 2003

(65) Prior Publication Data

US 2003/0150440 A1 Aug. 14, 2003

(30) Foreign Application Priority Data

Feb. 8, 2002 (JP) ..... 2002-032549
Dec. 24, 2002 (JP) ..... 2002-372635

(51) Int. Cl.[7] ..... F02P 3/055

(52) U.S. Cl. ..... 123/634; 123/169 CA; 123/169 CB; 336/90

(58) Field of Search ..... 123/634, 635, 123/169 CA, 169 CB, 143 B, 143 C, 169 E, 169 P; 336/96, 92, 94, 90

(56) References Cited

U.S. PATENT DOCUMENTS 6,208,231 B1 * 3/2001 Oosuka et al. ..... 336/107
6,343,595 B1 * 2/2002 Nakabayashi et al. ..... 123/634
6,525,636 B1 * 2/2003 Oosuka et al. ..... 336/90
6,559,747 B2 * 5/2003 Shimoide et al. ..... 336/96
6,662,794 B2 * 12/2003 Nagata et al. ..... 123/634
2003/0189476 A1 * 10/2003 Nagata et al. ..... 336/90

FOREIGN PATENT DOCUMENTS

| | | | |
|---|---|---|---|
| JP | A-63-70508 | 3/1988 | |
| JP | A-10-241974 | 9/1998 | |
| JP | 2002-144902 | 5/2002 | |
| JP | 303726 | * 10/2003 | ..... H01F/38/12 |
| JP | 332156 | * 11/2003 | ..... H01F/38/12 |

* cited by examiner

*Primary Examiner*—Hai Huynh
(74) *Attorney, Agent, or Firm*—Nixon & Vanderhye P.C.

(57) ABSTRACT

An ignition coil has an outer coil unit, an inner coil unit, a coil case in which the outer and inner coil units are housed and a tower case accommodating lower parts of outer and inner spools. The outer spool is made of resin material whose bonding strength to resin insulating material, with which the tower case is filled, is weak. An axial leading end of the outer spool is positioned axially away from a reference position by a distance equal to or shorter than 60% of a reference length or by a distance equal to or longer than 90% of the reference length. With this ignition coil, cracks are suppressed on the resin insulating material opposed to the axial leading end of the outer spool otherwise caused by thermal stress.

20 Claims, 8 Drawing Sheets

IGNITION COIL FOR INTERNAL COMBUSTION ENGINE

CROSS REFERENCE TO RELATED APPLICATIONS

This application is based upon and claims the benefit of priority of Japanese Patent Applications No. 2002-32549 filed on Feb. 8, 2002 and No. 2002-372635 filed on Dec. 24, 2002, the contents of which are incorporated herein by reference.

BACKGROUND OF THE INVENTION

1. Field of the Invention

The present invention relates to an ignition coil for an internal combustion engine (hereinafter called an ignition coil).

2. Description of Related Art

In the past, high voltage was applied to spark plugs via a high tension coil from a mechanical distributor. However, it has been a recent tendency to apply the high voltage directly to each of the spark plugs from an independent type ignition coil provided individually for each cylinder of an internal combustion engine (engine), as disclosed in JP-A-63-70508.

In the independent type ignition coil, an inside of its case (housing) is filled with resin insulating material such as epoxy resin for not only securing better electric insulation between component parts constituting the ignition coil but also holding stably the component parts.

Since the independent type ignition coil is installed in a plug hole of the engine and is likely influenced by heat or vibration from the engine, the resin insulating material in the ignition coil is apt to crack under the influence of thermal stresses due to cooling and heating cycles. It is a problem that a crack in the resin insulating material results in a shortened insulation distance, which can cause insulation breakdown.

To prevent the resin insulating material from cracking, in the conventional ignition coil, a separation tape whose bonding force to the resin insulating material is weak or resin resilient layer is used at the outer circumference of a primary spool to relieve the thermal stresses acting on the resin insulating material, as disclosed in JP-A-10-241974.

However, the use of the separation tape or the resin resilient layer results in increasing the number of component parts and the time necessary for their assembly so that the ignition coil is more expensive.

To achieve an inexpensive ignition coil, it is proposed with a prior Japanese Patent Application No. 2002-144902 filed on May 20, 2002 by the same applicant that the primary spool (outer spool) is made of resin material easily separable from the resin insulating material. However, the present inventors' experimental test result and analysis reveals a drawback in that a crack tends to occur in the resin insulating material at a position where an axial leading end of the primary spool exists. This is because the resin insulating material, whose bonding strength to the primary spool is weak, is separated from the primary spool by thermal stress due to cooling and heating cycles, which causes steps at an edge corner portion of the resin insulating material at a position opposed to the axial leading end of the primary spool. On the other hand, in the conventional ignition coil the resin material used for the primary spool has strong bonding strength to the resin insulating material and the separation tape is used only at a position where a primary coil is wound on the primary spool, the resin insulating material is firmly adhered to and not separated from the axial leading end of the primary spool.

SUMMARY OF THE INVENTION

The present invention has been made as a result of the present inventors' experimental test, which reveals that a crack is likely to occur on the edge corner portion of the resin insulating material if the axial leading end of the primary coil is at a certain position between a center core and a high voltage metal fitting.

An object of the present invention is to provide an ignition coil for an internal combustion engine in which cracks hardly occur on resin insulating material opposed to an axial leading end of an outer spool by thermal stress due to cooling and heating cycles, even if the outer spool is made of resin material whose bonding strength to the resin insulating material is weak.

To achieve the above object, the ignition coil to be directly connected with a plug terminal of a spark plug has an inner coil unit, outer coil unit, a secondary terminal, a coil case accommodating a substantial part of the inner and outer coil units, a high voltage tower case having a pipe shaped tower case to be coupled with the spark plug and a metal fitting arranged centrally inside the pipe shaped tower case for connecting in circuit the secondary terminal with the plug terminal and a resin insulating material.

The inner coil unit is composed of an inner spool, an inner coil wound on the inner spool and a center core made of magnetic material and housed centrally inside the inner spool. The outer coil unit is composed of an outer spool positioned radially outside the inner coil unit and an outer coil wound on the outer spool. The inner and outer coil units are arranged concentrically. High voltage induced in one of the inner and outer coils is applied to the secondary terminal when the other of the inner and outer coils is energized. The pipe shaped tower case on a side axially opposite to the spark plug is connected with an axial end of the coil case and the metal fitting is provided with a main body that blocks an opening of the pipe shaped tower case to the coil case so that the coil case and the pipe shaped tower case form an inner space which accommodates axial leading ends of the inner and outer spools on a side of the spark plug. The inner space is filled with the resin insulating material.

With the ignition coil mentioned above, the outer spool is made of resin material whose bonding strength to the resin insulating material is weak and the axial leading end of the outer spool is positioned axially away from a reference position by a distance equal to or shorter than 60% of a reference length or by a distance equal to or longer than 90% of the reference length, where the reference position is an axial end of the center core on a side of the spark plug and the reference length is an axial length between the reference position and an axial end of the main body of the metal fitting on a side opposite to the spark plug.

It is preferable that the inner spool is provided with a ring shaped inner flange protruding radially outward for holding an axial end of the inner coil on a side of the spark plug and the axial leading end of the outer spool is positioned axially away from the reference position by a distance same as or longer than a surface of the inner flange that holds the axial end of the inner coil. This construction serves to prevent creeping discharge or short circuit between the inner and outer coils.

Preferably, the outer spool is provided with a ring shaped outer flange protruding radially outward for holding an axial end of the outer coil on a side of the spark plug and a cylindrical outer skirt extending from the outer flange toward the spark plug so that the axial leading end of the outer spool is an axial end of the cylindrical outer skirt on a side of the spark plug.

The outer flange may be at a position axially same as the inner flange, may be positioned on a side axially opposite to the spark plug with respect to the inner flange, or may be positioned on a side of the spark plug with respect to the inner flange.

When the outer flange is positioned on a side axially opposite to the spark plug with respect to the inner flange, it is preferable that the axial end of the cylindrical outer skirt on a side of the spark plug is at a position axially same as or more away from the reference position than a surface of the inner flange that holds the axial end of the inner coil.

The outer spool may have the ring shaped outer flange without the cylindrical outer skirt extending from the outer flange toward the spark plug so that the axial leading end of the outer spool is a surface of the outer flange on a side of the spark plug. In this case, it is preferable that the surface of the outer flange on a side of the spark plug is at a position more away from the reference position than a surface of the inner flange that holds the axial end of the inner coil.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Preferred embodiments of the present invention are described with reference to drawings.

(First Embodiment)

Figure 1:
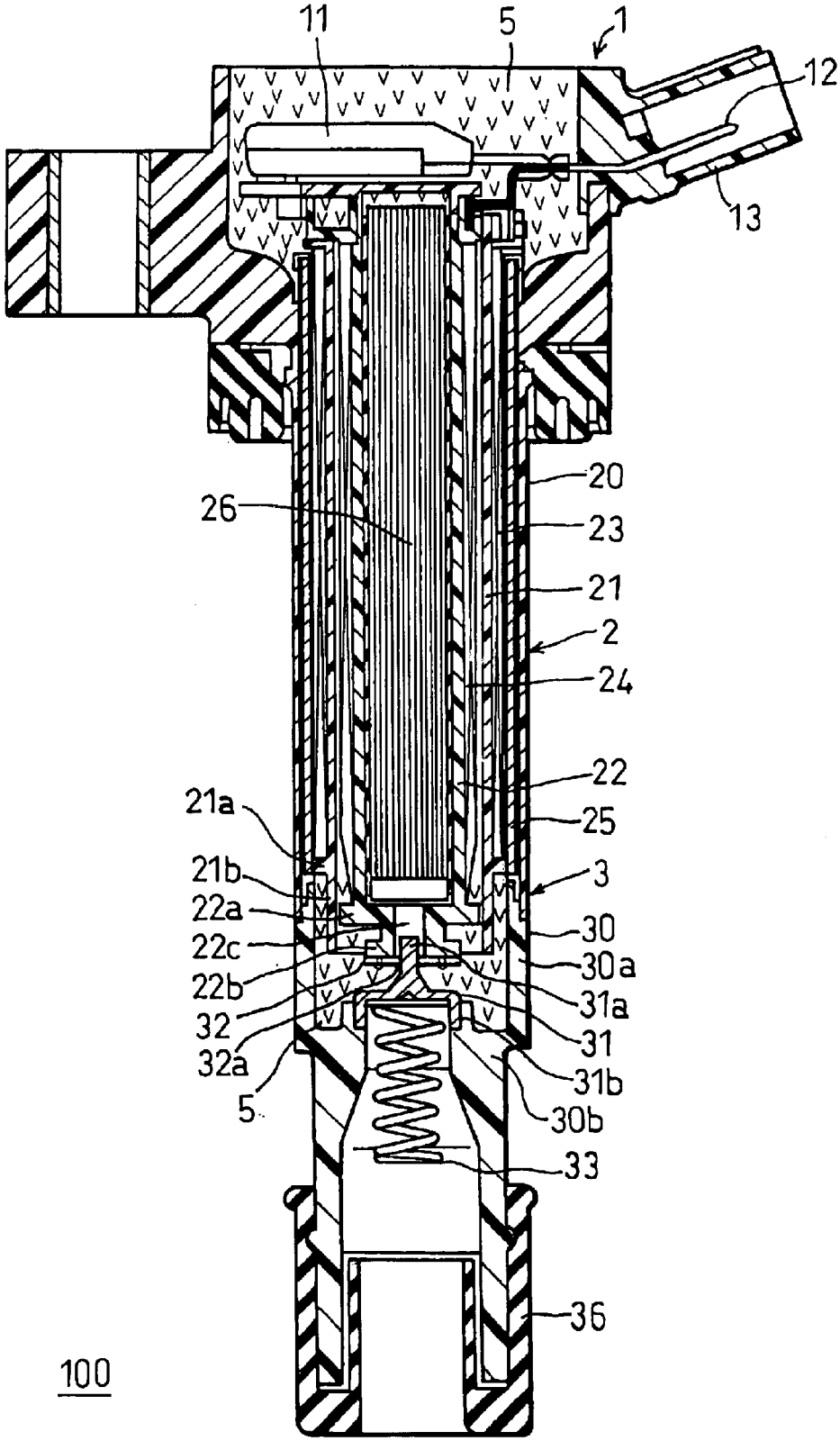
FIG. 1 is a cross sectional view of an ignition coil according to a first embodiment.

FIG. 1 shows an ignition coil 100 for an engine (hereinafter called ignition coil 100) according to a first embodiment of the present invention. The ignition coil 100 is a stick-type ignition coil installed in a plug hole of an engine block provided individually for each cylinder of the engine. The ignition coil 100 is mainly composed of a control section 1, a coil section 2 and a high voltage tower section 3.

The control section 1 has a terminal 12 formed in a connector 13 by insert injection molding and an igniter 11 connected with the terminal 12. The igniter 11 receives via the terminal 12 an ignition signal from ECU (not shown). Upon receipt of the ignition signal, the igniter 11 switches on and supplies primary current to a primary coil 23 so that a spark plug intermittently discharges.

The coil section 2 is composed of a coil case 20 constituting an outside housing, an outer circumference core 25 arranged inside the coil case 20, a primary coil unit (outer coil unit) arranged inside the outer circumference core 25 in which the primary coil (outer coil) 23 is wound on a primary spool (outer spool) 21, a secondary coil unit (inner coil unit) arranged inside the primary coil unit in which a secondary coil (inner coil) 24 is wound on a secondary spool (inner spool) 22, and a center core 26 arranged in a center of the coil case 20 and inside the secondary coil unit. These components constitute a closed magnetic path so that battery voltage (about 12 V) supplied to the primary coil unit is increased to high voltage (about 30 kV) necessary for the spark plug to discharge at the secondary coil unit.

The high voltage tower section 3 is composed of a tower case 30 that is formed in shape of a cylinder having a step and fixed to a lower end of the coil case 20, a rubber plug cap 36 that is fitted to a lower end of the tower case 30 and closely contacts and holds (coupled with) the spark plug positioned in a center thereof, a secondary terminal 32 connected with an end of the secondary coil 24, a high voltage metal fitting 31 arranged in a center of the tower case 30 to connect in circuit with the secondary terminal 32 and a high voltage spring 33 (resilient metal fitting) in resilient contact with and retained by the high voltage metal fitting 31 and a plug terminal of the spark plug (not shown).

Figure 2:
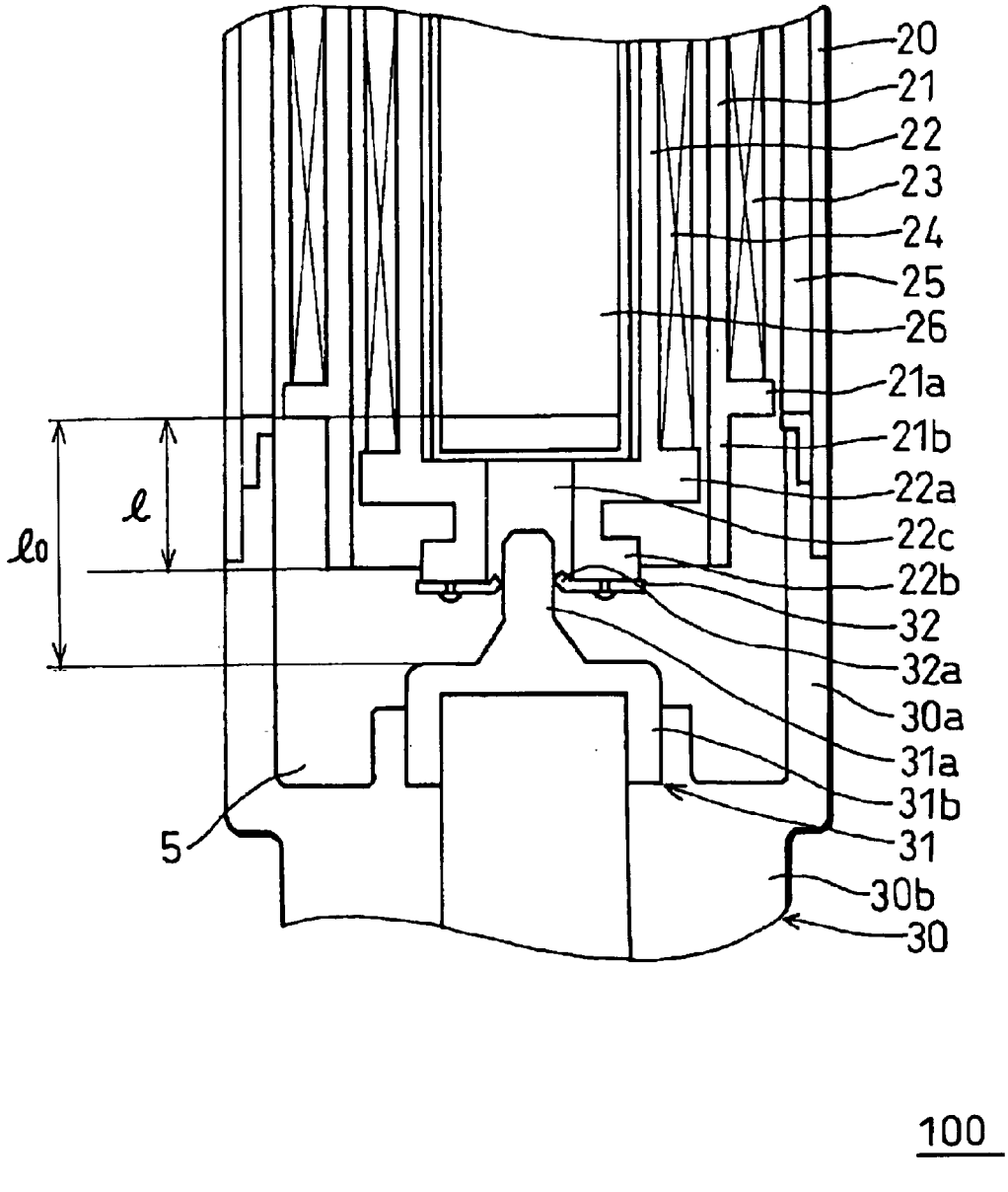
FIG. 2 is an enlarged cross sectional view of a part of the ignition coil shown in FIG. 1.

As shown in FIG. 2, the tower case 30 is formed in shape of a cylinder provided inside with the step. The tower case 30 has an upper cylinder 30*a* whose inner space accommodates lower ends of the first and second spools 21 and 22 and is filled with resin insulating material 5 and a lower cylinder 30*b* which is connected to a lower end of the upper cylinder 30*a*, whose inner diameter is smaller than that of the upper cylinder 30*a* and which accommodates the plug terminal.

The primary spool 21 is provided at the lower end thereof with a ring shaped flange 21*a* (outer flange) that retains the lower end of the primary coil 23 and serves to position in place inside the outer circumference core 25. The primary spool 21 is further provided with a cylindrical skirt 21*b* extending downward from the flange 21*a*. Inner and outer diameters of the skirt 21*b* are same as those of a portion of the primary spool 21 on which the primary coil 23 is wound. The skirt 21*b* covers entire outer circumference of the lower end of the secondary spool 22. Length of the skirt 21*b* is described later.

The secondary spool 22 is provided at the lower end thereof with a ring shaped flange 22*a* (inner flange) that retains the lower end of the secondary coil 24 and serves to position in place inside the primary spool 21, similarly as the primary spool 21. The flange 22*a* of the secondary spool 22 is positioned axially below the flange 21*a* of the primary spool 21.

The secondary spool 22 is further provided on a lower side of the flange 22*a* with a step flange 22*b* and in a center thereof with a communication bore 22*c* which extends axially and through which inside and outside thereof communicate with each other. The step flange 22*b* has lateral bores (not shown) from which the resin insulating material 5 enters the inside of the secondary spool 22 via the communication bore 22 so that the center core 26 is insulated and fixed by the resin insulating material 5.

Each of the primary and secondary spools 21 and 22 is formed into one piece by resin injection molding. The primary spool 21 is made of SPS (Syndyotactic Poly Styrene) as its material and the secondary spool 22 is made of PPE (Poly phenylene Ether) as its material that is resin whose bonding strength to the resin insulating material 5 is stronger than that of SPS.

A secondary terminal 32, a ring shaped metal fitting, is mounted on a lower end surface of the step flange 22*b*. An inner circumferential periphery of the secondary terminal 32 is bent into the communication bore 22*c*. The high voltage metal fitting 31 is provided on an upper side thereof with a pillar shaped projection 31*a* inserted into the communication bore 22*c* of the secondary spool 22 and in contact with the inner circumferential periphery of the secondary terminal 32. The high voltage metal fitting 31 is provided on a lower side thereof with a cup 31*b* formed in shape of a cylinder having a bottom. The cup 31*b* is press fitted to inner circumference of an upper end opening of the lower cylinder 30*b* of the tower case 30 so that the upper end opening of the lower cylinder 30*b* is covered with the cap 31*b*. Press fitting surfaces of the cup 31*b* and the lower cylinder 30*b* constitute seal surfaces through which the resin insulating material 5, with which upper space of the tower case 30 is filled, is prevented from leaking outside.

A gist of the present invention is described with reference to FIGS. 2 and 3.

Length between an axial lower end of the center core 26 (reference position) and an upper end of outer circumference of the cup 31*b* of the high voltage metal fitting 31 (main body position) is defined to be $l_0$ that is reference length. Length between the reference position and an axial lower end position of the skirt 21*b* is defined to be l. According to the first embodiment, a lower surface position of the flange 21*a* of the primary spool 21 is at a position axially same as the axial lower end position of the center core 26 (the reference position) so that the length of the skirt 21*b* is substantially equal to 1.

Stress strain ($\epsilon$) is generated on the resin insulating material 5 (epoxy resin) at the lower end inner circumference of the skirt 21*b*. In particular, the stress strain ($\epsilon$), which is thermal stress due to the cooling and heating cycle, tends to be focused on an edge corner portion of the resin insulating material 5 opposed to a corner of the lower end inner circumference of the skirt 21*b* and likely causes cracks on the edge corner portion, since the bonding force between the resin insulating material 5 and the primary spool 21 is weak so that the edge corner portion of the resin insulating material 5 not closely bonded to the skirt 21*b* is deformed by thermal stress due to the cooling and heating cycle.

An experimental test is conducted in use of plural samples of the ignition coils 100 each of which has different length of the skirt 21*b* of the primary spool 21. FIG. 3 shows the test result.

Figure 3:
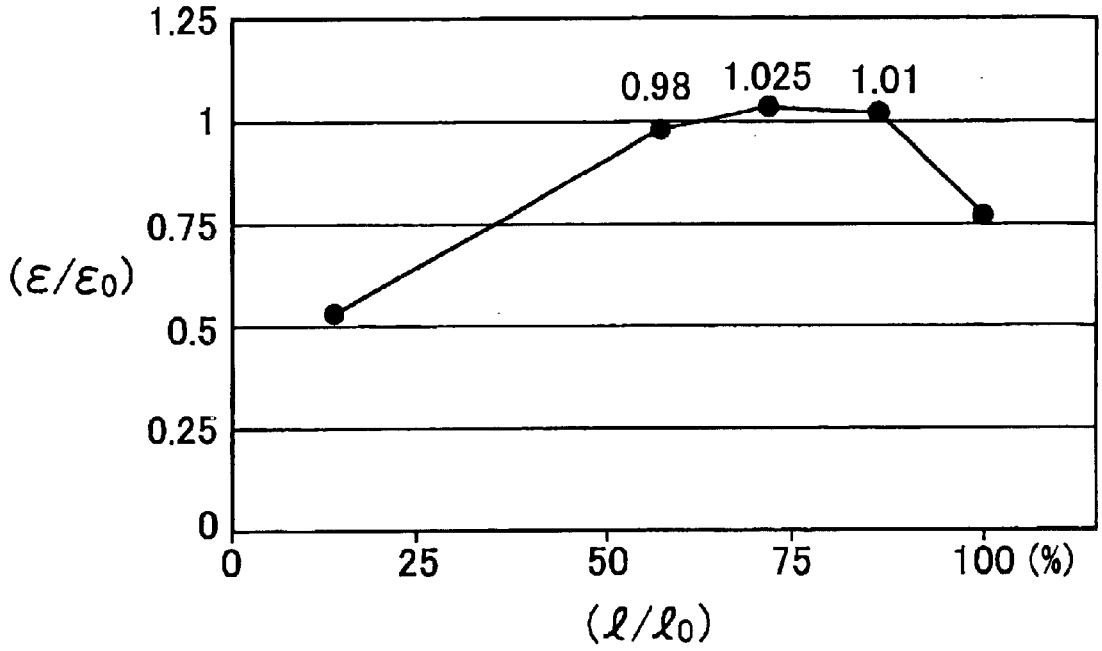
FIG. 3 is a graph showing a relationship between position of an axial leading end of a primary spool and stress strain of resin insulating material according to the first embodiment.

The vertical axis of FIG. 3 shows a ratio ($\epsilon/\epsilon_0$) of actual stress strain ($\epsilon$) generated in the epoxy resin to breakdown stress strain ($\epsilon_0$) of the epoxy resin. The horizontal axis thereof shows a ratio ($l/l_0$) of actual length (l) between the reference position and an axial lower end position of the skirt 21*b* (length of the skirt 21*b*) to the reference length ($l_0$). According to the first embodiment, $l_0$=14 mm.

It is known from various experimental tests that, if the actual stress strain ($\epsilon$) generated in the epoxy resin is below the breakdown stress strain ($\epsilon_0$), the epoxy resin can stand the actual use without cracking. Therefore, the length of the skirt 21*b* is defined so as to satisfy a condition that the stress strain ($\epsilon$) generated in the resin insulating material 5 (epoxy resin) at the lower end inner circumference of the skirt 21*b* is below the breakdown stress strain ($\epsilon_0$) thereof.

As understood from the test results shown in FIG. 3, unless the ratio ($l/l_0$) falls within a range from 60% to 85%, the stress strain ($\epsilon$) generated in the resin insulating material 5 is always below the breakdown stress strain ($\epsilon_0$) so that the crack does not occur in the resin insulating material 5. It is preferable that the axial lower end of the skirt 21*b* is positioned axially away from the axial lower end of the center core 26 (the reference position) by a distance equal to or shorter than 60% of the reference length $l_0$ or by a distance equal to or longer than 90% of the reference length $l_0$.

What is concluded from the test result is as follows.

The secondary coil 24 and the center core 26 (each of which has thermal deformation smaller than that of the resin insulating material 5), are positioned inside the primary spool 21. Accordingly, the secondary coil 24 and the center core 26 restrict thermal radial shrinking deformation of the resin insulating material 5 inside the primary spool 21. If the axial lower end of the skirt 21*b* is positioned within a first range where thermal radial shrinking deformation of the resin insulating material 5 is substantially restricted, in particular, by the center core 26. That is, if the axial lower end of the skirt 21*b* is at a position not far away from the axial lower end of the center core 26, thermal deformation of the edge portion of the resin insulating material 5 is restricted to an extent that the stress strain ($\epsilon$) forcused on the edge corner portion is relatively small and does not cause a crack.

If the axial lower end of the skirt 21*b* is positioned within a second range where the thermal radial shrinking deformation of the resin insulating material 5 is not sufficiently restricted by the center core 26, that is, if the axial lower end of the skirt 21*b* is at a position away from the axial lower end of the center core 26 by a distance exceeding 60 % of the reference length $l_0$, the thermal deformation of the edge portion of the resin insulating material 5 is not sufficiently restricted so that a crack likely occurs on the edge corner portion caused by cooling and heating cycles.

Further, if the axial lower end of the skirt 21*b* is positioned within a third range, thermal radial shrinking deformation of the resin insulating material 5 is not substantially restricted by the center core 26 but restricted by the main body of the high voltage metal fitting 31 whose thermal deformation is smaller than that of the resin insulating materials. That is, if the axial lower end of the skirt 21*b* is at a position far away from the axial lower end of the center core 26 by a distance equal to or longer than 90% of the reference length $l_0$, thermal deformation of the edge corner portion of the resin insulating material 5 is restricted to an extent that the stress strain ($\epsilon$) focused on the edge corner portion is relatively small and does not cause a crack.

According to the first embodiment, the main body of the high voltage metal fitting 31 is a body formed in shape of the cup 31*b*. However, the main body of the high voltage metal fitting 31 may be a body formed in any shape, as far as the body has a volume sufficient enough to restrict the thermal deformation of the edge corner portion of the resin insulating material 5.

Further, according to the first embodiment, the flange 21*a* of the primary spool 21 is positioned axially above the flange 22*a* of the secondary spool 22. The skirt 21*b* axially extends from the lower end of the flange 21*a* toward the high voltage metal fitting 31. The skirt 21*b* is provided for a purpose of preventing creeping discharge or short circuit between the primary and secondary coils 23 and 24. Accordingly, it is preferable that the axial lower end of the skirt 21*b* is at a position axially same as or axially beyond the axial lower end of the flange 22*a*.

(Second Embodiment)

Figure 4:
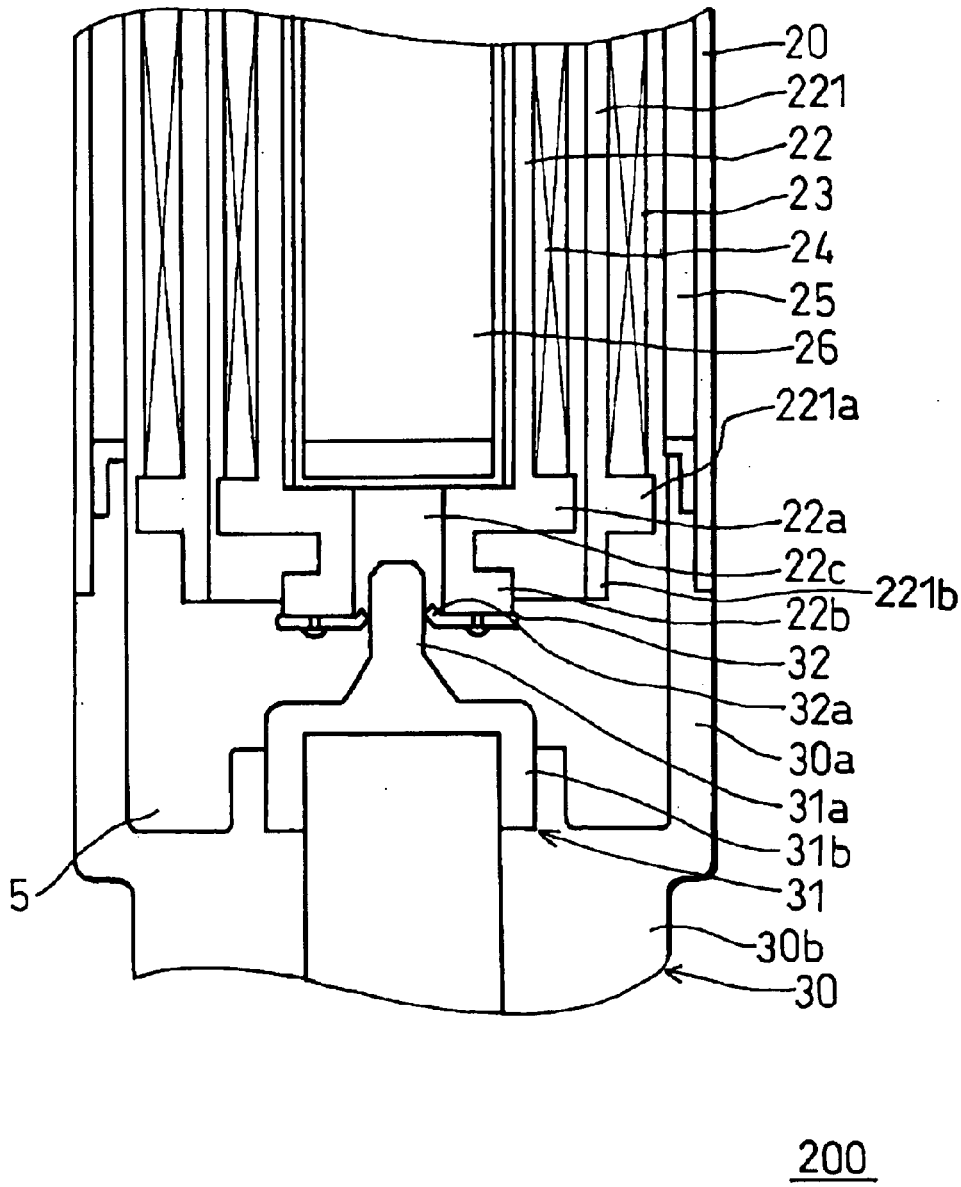
FIG. 4 is an enlarged cross sectional view of a part of the ignition coil according to a second embodiment.

An ignition coil 200 according to a second embodiment is described with reference to FIG. 4.

According to the second embodiment, only shape of a primary spool 221 is different from that of the primary spool 21 according to the first embodiment. A flange 221*a* of the primary spool 221 is at a position axially same as the flange 22*a* of the secondary spool 22. A skirt 221*b* axially extends from the lower end of the flange 221*a* toward the high voltage metal fitting 31. The axial lower end of the skirt 221*b* is positioned axially away from the axial lower end of the center core 26 (the reference position) by a distance equal to or shorter than 60% of the reference length $l_0$ or by a distance equal to or longer than 90% of the reference length $l_0$. For a purpose of preventing the crack of the resin insulating material 5 due to the cooling and heating cycle, the ignition coil 200 according to the second embodiment has the same advantage as the ignition coil 100 according to the first embodiment.

(Third Embodiment)

Figure 5:
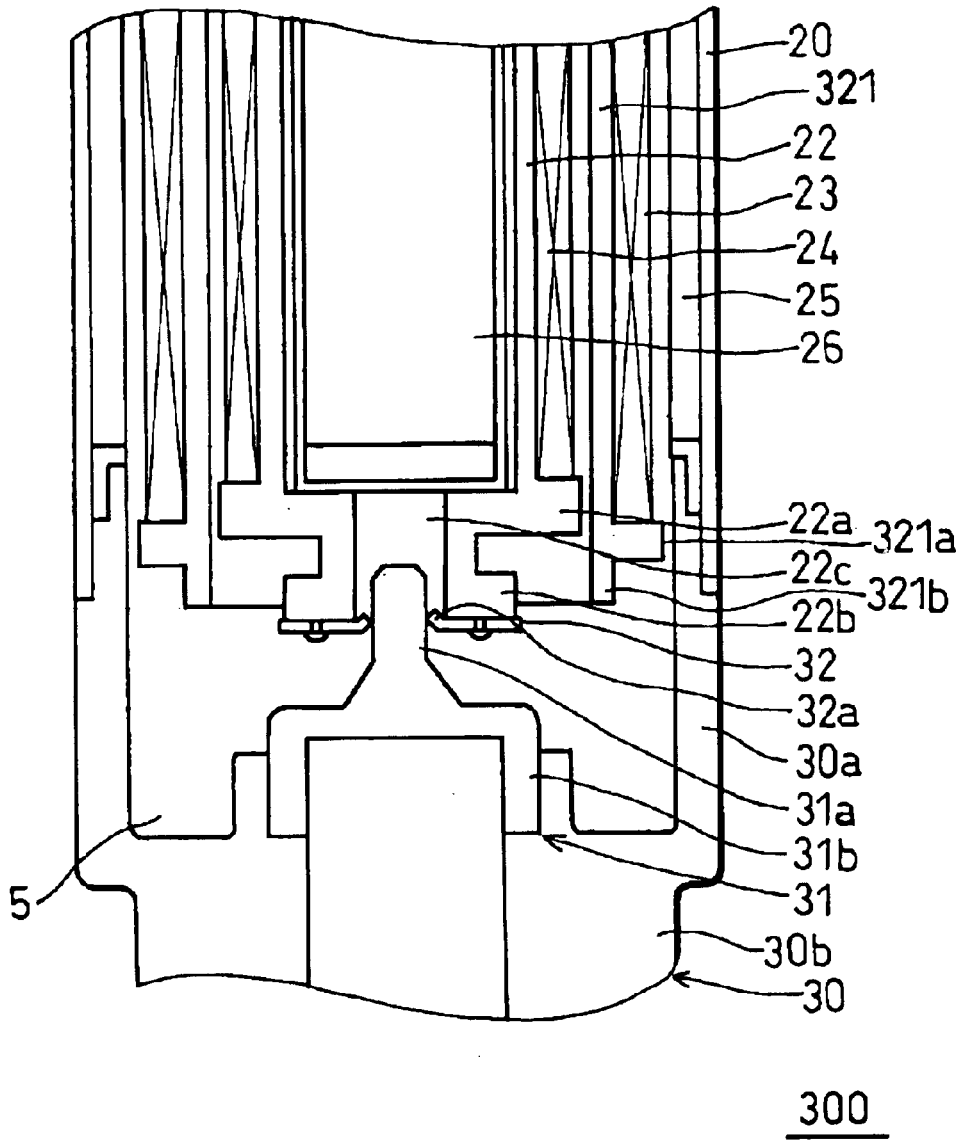
FIG. 5 is an enlarged cross sectional view of a part of the ignition coil according to a third embodiment.

An ignition coil 300 according to a third embodiment is described with reference to FIG. 5.

According to the third embodiment, only shape of a primary spool 321 is different from that of the primary spool 21 according to the first embodiment. A flange 321*a* of the primary spool 321 is at a position axially below the flange 22*a* of the secondary spool 22. A skirt 321*b* axially extends from the lower end of the flange 321*a* toward the high voltage metal fitting 31. The axial lower end of the skirt 321*b* is positioned axially away from the axial lower end of the center core 26 (the reference position) by a distance equal to or shorter than 60% of the reference length $l_0$ or by a distance equal to or longer than 90% of the reference length $l_0$. For a purpose of preventing the crack of the resin insulating material 5 due to the cooling and heating cycle, the ignition coil 300 according to the third embodiment has the same advantage as the ignition coil 100 according to the first embodiment.

(Fourth Embodiment)

Figure 6:
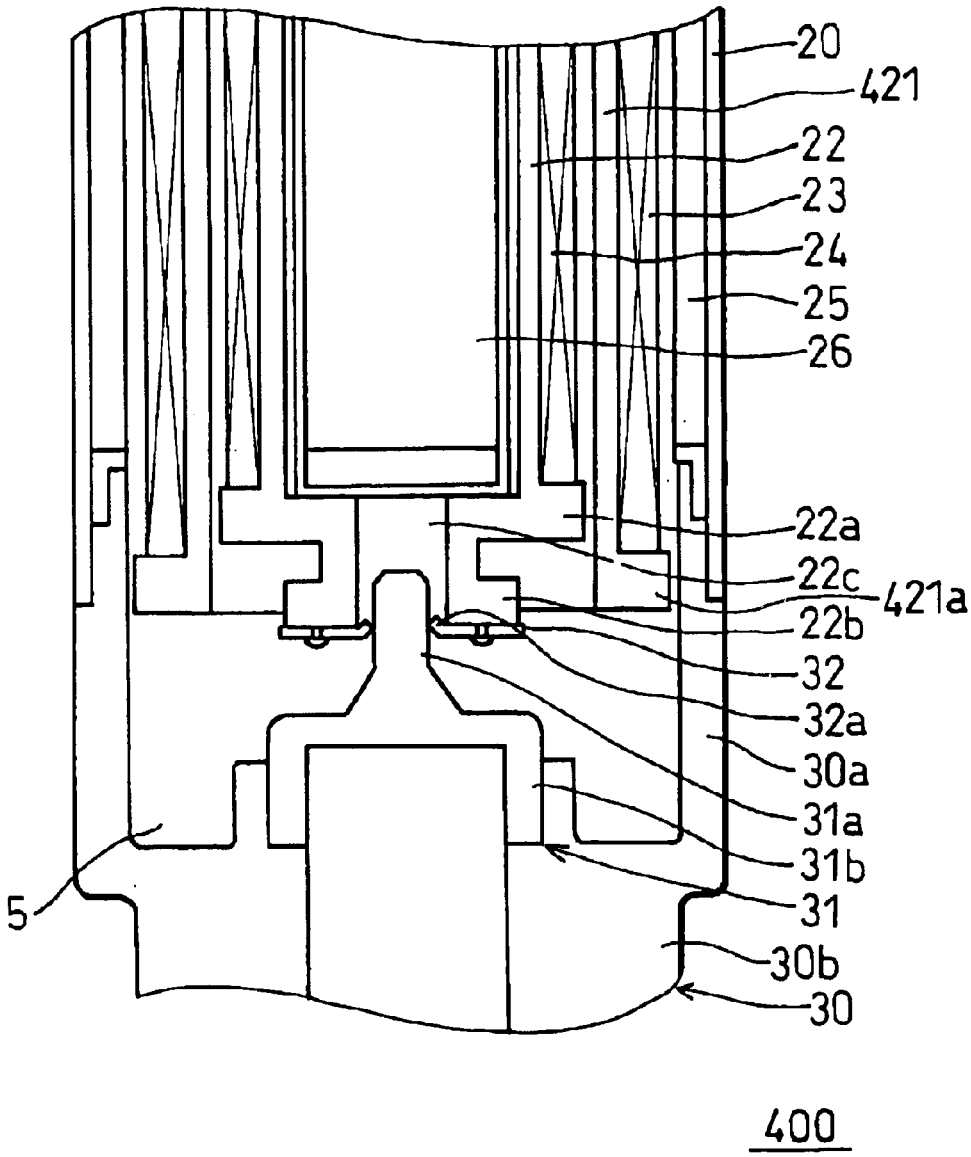
FIG. 6 is an enlarged cross sectional view of a part of the ignition coil according to a fourth embodiment.

An ignition coil 400 according to a fourth embodiment is described with reference to FIG. 6.

According to the fourth embodiment, only shape of a primary spool 421 is different from that of the primary spool 21 according to the first embodiment. A flange 421*a* of the primary spool 421 is at a position axially below the flange 22*a* of the secondary spool 22. The primary spool 421 according to the fourth embodiment does not have a skirt, though the primary spool 21 according to the first embodiment has the skirt 21*b*. The axial lower end of the flange 421*a* is positioned axially away from the axial lower end of the center core 26 (the reference position) by a distance equal to or shorter than 60% of the reference length $l_0$ or by a distance equal to or longer than 90% of the reference length 10. For a purpose of preventing the crack of the resin insulating material 5 due to the cooling and heating cycle, the ignition coil 400 according to the fourth embodiment has the same advantage as the ignition coil 100 according to the first embodiment.

(Fifth Embodiment)

Figure 7:
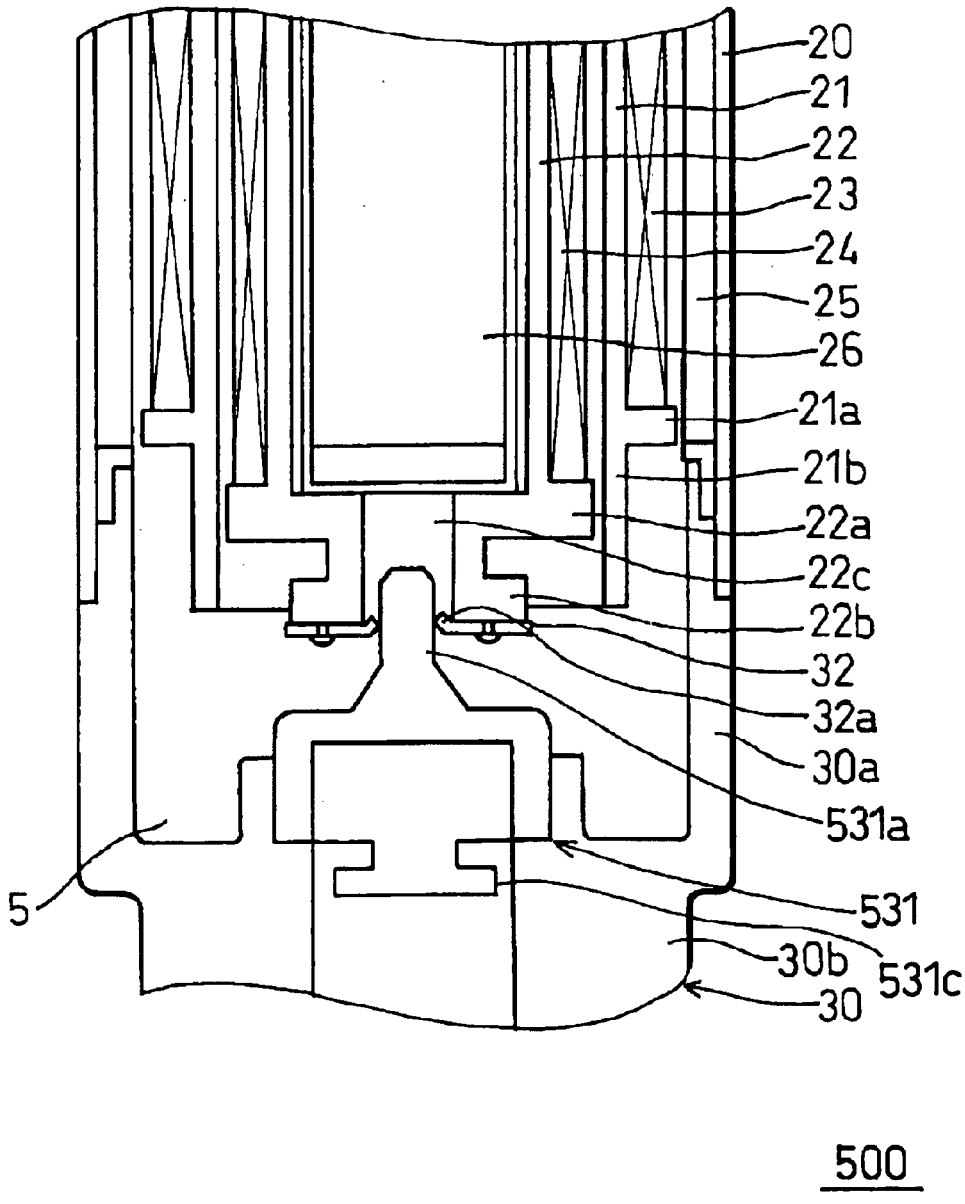
FIG. 7 is an enlarged cross sectional view of a part of the ignition coil according to a fifth embodiment.

An ignition coil 500 according to a fifth embodiment is described with reference to FIG. 7.

According to the fifth embodiment, only shape of a high voltage metal fitting 531 is different from that of the high voltage metal fitting 31 of the first embodiment. The high voltage metal fitting 531 is formed in shape of a short length column, which constitutes the main body thereof instead of the cup 31*b* of the first embodiment. The high voltage metal fitting 531 is provided on an upper side thereof with a pillar shaped projection 531*a* extending toward the secondary terminal 32, which is similar to the pillar shaped projection 31*a* of the first embodiment. The high voltage metal fitting 531 is further provided on a lower end thereof with a retaining piece 531*c* for retaining the high voltage spring 33. The high voltage metal fitting 531 has the same function and advantage as those of the high voltage metal fitting 31 of the first embodiment.

(Sixth Embodiment)

Figure 8:
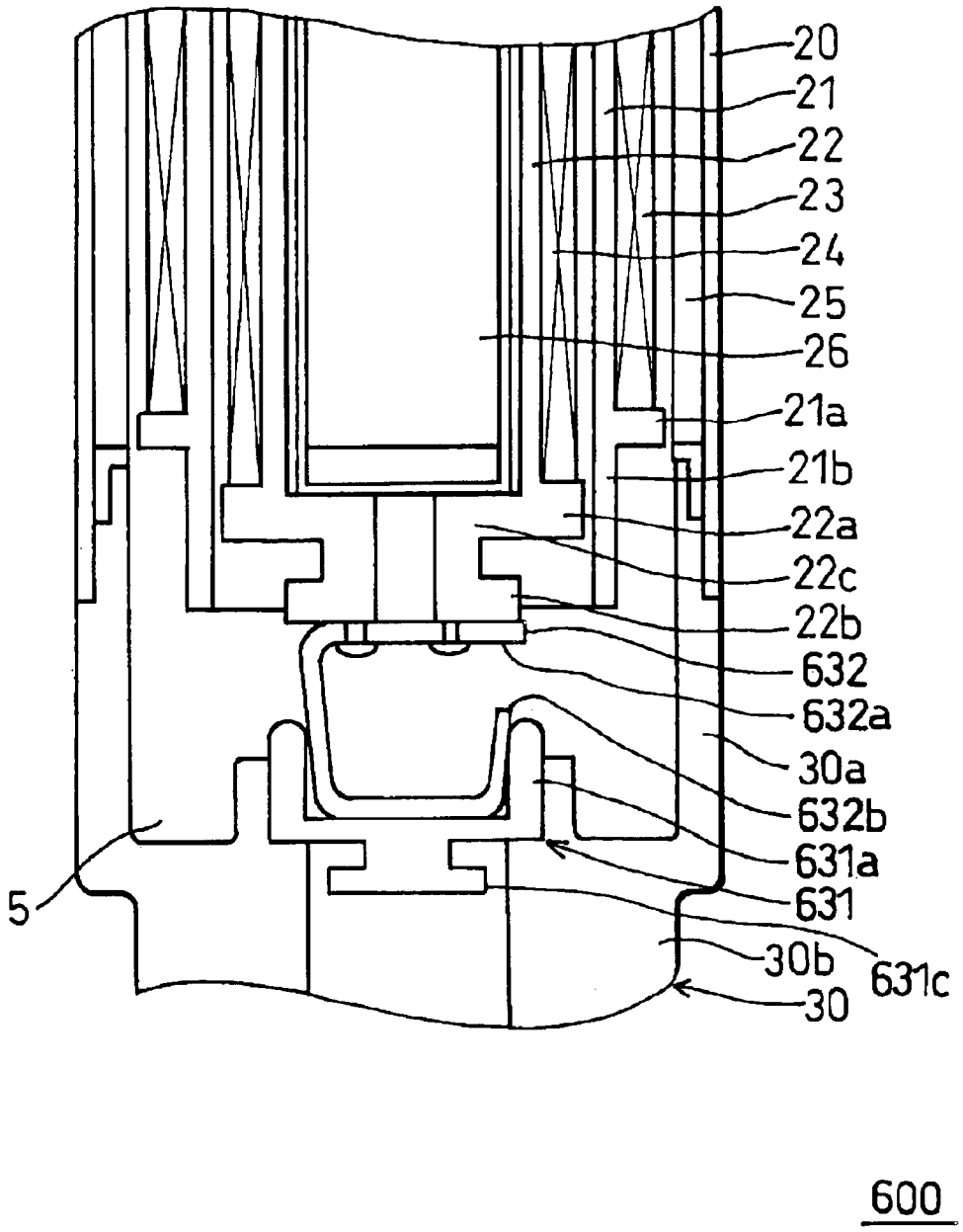
FIG. 8 is an enlarged cross sectional view of a part of the ignition coil according to a sixth embodiment.

An ignition coil 600 according to a sixth embodiment is described with reference to FIG. 8.

According to the sixth embodiment, shapes of a high voltage metal fitting 631 and a secondary terminal 632 are different from those of the high voltage metal fitting 31 and the secondary terminal 32 of the first embodiment.

The high voltage metal fitting 631 is formed is shape of a reverse cup provided on an upper side thereof with a receiving surface 631*a* and on a lower side thereof with a retaining piece 631*c* for retaining the high voltage spring 33.

The secondary terminal 632 is made of a cupper plate and formed in shape of substantially square or rectangular whose one side is partly opened. The secondary terminal 632 is provided on an upper side thereof with a mounting surface 632*a* fixed to the lower end of the step flange 22*b* and on a lower side thereof with a contact surface 632 in resilient contact with and retained by the receiving surface 631*a* of the high voltage metal fitting 631. The main body reference position is a ring shaped upper end of the receiving surface 631*a*. The high voltage metal fitting 631 and the secondary terminal 632 have the same function and advantage as those of the high voltage metal fitting 31 and the secondary terminal 32 of the first embodiment.

In the first to fifth embodiments mentioned above, instead of arranging the outer circumference core 25 inside the coil case 20, the outer circumference core 25 may be arranged outside the coil case 20.

Further, though the coil case 20 and the tower case 30 are formed separately and, then, connected with each other in the first to sixth embodiments, the coil case 20 and the tower case 30 may be formed integrally.

Moreover, though the primary coil unit is the outer coil unit and the secondary coil unit is the inner coil unit in the first to sixth embodiments, the primary coil unit may be arranged as the inner coil unit and the secondary coil unit as the outer coil unit. Accordingly, the secondary terminal is connected in circuit with a secondary coil wound on a secondary spool of the outer coil unit for inducing high voltage. In this case, the axial end of the secondary spool should be positioned away from the axial end of the center core 26 (the reference position) by a distance equal to or shorter than 60% of the reference length $l_0$ or by a distance equal to or longer than 90% of the reference length $l_0$.

Furthermore, an upper and lower positional relationship described throughout the specification is defined for a convenience based on a preposition that the ignition coil is positioned on an upper side and the spark plug is positioned on a lower side, which are illustrated in the drawings, and not based on a preposition that the ignition coil is actually mounted on the engine.

What is claimed is:

1. An ignition coil to be directly connected with a plug terminal of a spark plug for an internal combustion engine, said coil comprising:

an inner coil unit having an inner spool made of PPE, an inner coil wound on the inner spool and a center core made of magnetic material and housed centrally inside the inner spool;

an outer coil unit having an outer spool made of SPS and positioned radially outside the inner coil unit and an outer coil wound on the outer spool, the inner and outer coil units being arranged concentrically;

a secondary terminal to which high voltage induced in one of the inner and outer coils is applied when the other of the inner and outer coils is energized;

a coil case accommodating a substantial part of the inner and outer coil units;

a high voltage tower case having a pipe shaped tower case to be coupled with the spark plug and a metal fitting arranged centrally inside the pipe shaped tower case for connecting in circuit the secondary terminal with the plug terminal, the pipe shaped tower case on a side axially opposite to the spark plug being connected with an axial end of the coil case, and the metal fitting being provided with a main body that blocks an opening of the pipe shaped tower case to the coil case so that the coil case and the pipe shaped tower case form an inner space which accommodates axial leading ends of the inner and outer spools on a side of the spark plug; and resin insulating material which is made of epoxy resin with which the inner space is filled, wherein the outer spool is made of resin material of SPS whose bonding strength to the resin simulating material is weaker than that of the resin material of PPE for the inner spool and the axial leading end of the outer spool is positioned axially away from a reference position by a distance (a) equal to or shorter than 60% of a reference length or (b) by a distance equal to or longer than 90% of the reference length, where the reference position is an axial end of the center core on a side of the spark plug and the reference length is an axial length between the reference position and an axial end of the main body of the metal fitting on a side opposite to the spark plug.

2. An ignition coil as in claim 1, wherein the inner spool is provided with a ring shaped inner flange protruding radially outward for holding an axial end of the inner coil on a side of the spark plug and the axial leading end of the outer spool is positioned axially away from the reference position by a distance same as or longer than a surface of the inner flange that holds the axial end of the inner coil.

3. An ignition coil as in claim 1, wherein the outer spool is provided with a ring shaped outer flange protruding radially outward for holding an axial end of the outer coil on a side of the spark plug and a cylindrical outer skirt extending from the outer flange toward the spark plug so that the axial leading end of the outer spool is an axial end of the cylindrical outer skirt on a side of the spark plug.

4. An ignition coil as in claim 3, wherein the inner spool is provided with a ring shaped inner flange protruding radially outward for holding an axial end of the inner coil on a side of the spark plug and the outer flange is positioned on a side axially opposite to the spark plug with respect to the inner flange and, further, wherein the axial end of the cylindrical outer skirt on a side of the spark plug is at a position axially same as or more away from the reference position than a surface of the inner flange that holds the axial end of the inner coil.

5. An ignition coil as in claim 4, wherein an axial end of the cylindrical outer skirt on a side of the outer flange is at a position axially same as the reference position.

6. An ignition coil as in claim 3, wherein the inner spool is provided with a ring shaped inner flange protruding radially outward for holding an axial end of the inner coil on a side of the spark plug and the outer flange is at a position axially same as the inner flange.

7. An ignition coil as in claim 3, wherein the inner spool is provided with a ring shaped inner flange protruding radially outward for holding an axial end of the inner coil on a side of the spark plug and the outer flange is positioned on a side of the spark plug with respect to the inner flange.

8. An ignition coil as in claim 1, wherein the outer spool is provided with a ring shaped outer flange protruding radially outward for holding an axial end of the outer coil on a side of the spark plug so that the axial leading end of the outer spool is a surface of the outer flange on a side of the spark plug.

9. An ignition coil as in claim 8, wherein the inner spool is provided with a ring shaped inner flange protruding radially outward for holding an axial end of the inner coil on a side of the spark plug and the surface of the outer flange on a side of the spark plug is at a position more away from the reference position than a surface of the inner flange that holds the axial end of the inner coil.

10. An ignition coil as in claim 1, wherein the outer spool and the outer coil are a primary spool and a primary coil, respectively, and the inner spool and the inner coil are a secondary spool and a second coil connected in circuit with the secondary terminal, respectively.

11. A method for reducing the tendency of crack formation in the insulating epoxy filler of an ignition coil to be directly connected with a plug terminal of a spark plug for an internal combustion engine, method comprising:

making an inner coil unit spool of PPE, making an outer coil unit spool of SPS and positioning it radially outside the inner coil unit;

accommodating a substantial part of the inner and outer coil units in a coil case including a high voltage tower case having a pipe shaped tower case to be coupled with the spark plug and a metal fitting arranged centrally inside the pipe shaped tower case for connecting in circuit a secondary terminal with a plug terminal, the pipe shaped tower case on a side axially opposite to the spark plug being connected with an axial end of the coil case, and the metal fitting being provided with a main body that blocks an opening of the pipe shaped tower case to the coil case so that the coil case and the pipe shaped tower case form an inner space which accommodates axial leading ends of the inner and outer spools on a side of the spark plug; and filling the inner space with an epoxy resin insulating material, wherein the outer spool is made of resin material of SPS whose bonding strength to the resin insulating material is weaker than that of the resin material of PPE for the inner spool and the axial leading end of the outer spool is positioned axially away from a reference position by a distance (a) equal to or shorter than 60% of a reference length or (b) by a distance equal to or longer than 90% of the reference length, where the reference position is an axial end of the center core on a side of the spark plug and the reference length is an axial length between the reference position and an axial end of the main body of the metal fitting on a side opposite to the spark plug.

12. A method as in claim 11 wherein the inner spool is provided with a ring shaped inner flange protruding radially outward for holding an axial end of the inner coil on a side of the spark plug and the axial leading end of the outer spool is positioned axially away from the reference position by a distance same as or longer than a surface of the inner flange that holds the axial end of the inner coil.

13. A method as in claim 11 wherein the outer spool is provided with a ring shaped outer flange protruding radially outward for holding an axial end of the outer coil on a side of the spark plug and a cylindrical outer skirt extending form the outer flange toward the spark plug so that the axial leading end of the outer spool is an axial end of the cylindrical outer skirt on a side of the spark plug.

14. A method as in claim 13 wherein the inner spool is provided with a ring shaped inner flange protruding radially outward for holding an axial end of the inner coil on a side of the spark plug and the outer flange is positioned on a side axially opposite to the spark plug with respect to the inner flange and, further, wherein the axial end of the cylindrical outer skirt on a side of the spark plug is at a position axially same as or more away from the reference position than a surface of the inner flange that holds the axial end of the inner coil.

15. A method as in claim 14 wherein an axial end of the cylindrical outer skirt on a side of the outer flange is at a position axially same as the reference position.

16. A method as in claim 13 wherein the inner spool is provided with a ring shaped inner flange protruding radially outward for holding an axial end of the inner coil on a side of the spark plug and the outer flange is at a position axially same as the inner flange.

17. A method as in claim 13 wherein the inner spool is provided with a ring shaped inner flange protruding radially outward for holding an axial end of the inner coil on a side of the spark plug and the outer flange is positioned on a side of the spark plug with respect to the inner flange.

18. A method as in claim 11 wherein the outer spool is provided with a ring shaped outer flange protruding radially outward for holding an axial end of the outer coil on a side of the spark plug so that the axial leading end of the outer spool is a surface of the outer flange on a side of the spark plug.

19. A method as in claim 18 wherein the inner spool is provided with a ring shaped inner flange protruding radially outward for holding an axial end of the inner coil on a side of the spark plug and the surface of the outer flange on a side of the spark plug is at a position more away from the reference position than a surface of the inner flange that holds the axial end of the inner coil.

20. A method as in claim 11 wherein the outer spool and the outer coil are a primary spool and a primary coil, respectively, and the inner spool and the inner coil are a secondary spool and a secondary coil connected in circuit with the secondary terminal, respectively.

* * * * *